US006181890B1

(12) United States Patent
Kataoka et al.

(10) Patent No.: US 6,181,890 B1
(45) Date of Patent: Jan. 30, 2001

(54) IMAGE FORMING APPARATUS HAVING A CLEANING OPERATION FOR A FIXING DEVICE

(75) Inventors: Hiroshi Kataoka, Susono; Taro Fukuhara, Numazu, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/361,964

(22) Filed: Jul. 28, 1999

(30) Foreign Application Priority Data

Jul. 30, 1998 (JP) ..... 10-216327

(51) Int. Cl.[7] ..... G03G 15/00; G03G 15/20

(52) U.S. Cl. ..... 399/67; 399/43; 399/71

(58) Field of Search ..... 399/43, 67, 71, 399/98, 99, 327, 328; 219/216; 347/156; 430/97, 99, 124, 125

(56) References Cited

U.S. PATENT DOCUMENTS 5,168,314 * 12/1992 Gunji et al. ..... 399/327
5,512,729 * 4/1996 Kusaka et al. ..... 219/216
5,848,341 * 12/1998 Watanabe ..... 399/7.1 X

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an unfixed image forming device, a fixing device and a controller and that turns off the power supply to the heating member and rotational driving of the rotational members for a first preset predetermined time period when a continuous image forming completed for continuously forming images on a plurality of recording materials, and subsequently, turns on the power supply to the heating member and rotational driving of the rotational members for a predetermined preset second time period.

9 Claims, 7 Drawing Sheets

IMAGE FORMING APPARATUS HAVING A CLEANING OPERATION FOR A FIXING DEVICE

BACKGROUND OF THE INVENTION

1. Field of the Invention

The present invention relates to an image forming apparatus, such as a copying machine, a printer, which forms images utilizing the electrophotographic method. More particularly, the invention relates to an image forming apparatus provided with a fixing device that thermally fixes the unfixed toner images transferred to a recording material.

2. Related Background Art

To form images, the image forming apparatus that utilizes the electrophotographic method is arranged to charge the surface of the electrophotographic photosensitive body uniformly by use of the charging device, and to expose the charged surface of the electrophotographic photosensitive body by use of the exposing device, thus forming the electrostatic latent images. Then, the electrostatic latent images are developed by use of the developing device to form toner images. The toner images are transferred to a recording material, such as a recording sheet, by use of the transferring device. The toner images are then fixed on the recording material by use of the fixing device as permanently fixed images for output.

As shown in FIG. 8, the aforesaid fixing device is, for example, arranged to be able to pinch and convey by use of the guiding member 18 a recording material P which is provided with the unfixed toner transferred to it on the fixing nip unit N between the fixing roller 100 and the pressure roller 110, and then, to heat and press the toner T by the heater 13 that serves as the heating body arranged in the fixing roller 100 in order to fix the unfixed toner (unfixed toner images) T on the recording material P as the permanently fixed images.

The fixing roller 100 is structured with the releasing layer 10*b* formed by PFA, PTFE, or some other fluororesin on the core metal 10*a* formed by aluminum, iron, or the like. In the releasing layer 10*b*, the heater 13 is arranged as heating means to heat the fixing roller 100 from its inside.

The releasing layer 10*b* is provided for the prevention of the "offset phenomenon" which tends to stain the images to follow after the transfer of the unfixed toner images to the fixing roller 100. Here, further, by the utilization of the electrostatic charge given characteristically to the toner (that is, the negative polarity in the specification hereof), the electric potential of the negative polarity is generated on the surface of the fixing roller 100 when the bias of the negative polarity is applied to the core metal 10*a* from the fixing bias supply source 12. Thus, by the utilization of the force of repulsion of the negatively charged toner, the toner is allowed to adhere to the surface of the fixing roller 100 so as to prevent the occurrence of the offset phenomenon that may result in defects on the images to follow.

On the fixing roller 100, there are arranged the separating claws 14, and the thermistor 15 which serves as temperature detecting sensor.

The separating claws 14 are in contact with the surface of the fixing roller 100 to prevent the recording material P from being wound around the fixing roller 100 when it passes the fixing nip unit N. It is generally practiced to use the separating claws 14 which are coated with PFA, PTFE, or some other fluororesin having an excellent releasability for the prevention of the adhesion or accumulation of toner to or on the surface of the separating claws 14.

The thermistor 15 is in contact with the surface of the fixing roller 100 under a specific pressure to detect the surface temperature of the fixing roller 100. On the basis of the information of the surface temperature of the fixing roller 100 thus detected by the thermistor 15, the current to the heater 13 is turned on and off by use of a controller (not shown) so that the surface temperature of the fixing roller 100 is kept at a constant level.

The pressure roller 110 is pressed to the fixing roller 100 by use of pressure means (not shown) to form the fixing nip unit N. The pressure roller 110 is provided with the elastic layer 11*b* which is formed by the heat resistive silicon sponge rubber or the like on the core metal 11*a* formed by aluminum, iron, or the like, and on the elastic layer 11*b*, there is further provided the releasing layer 11*c* which is formed by the PFA, PTFE, or some other fluororesin having a minute quantity of conductive particles, such as carbon, dispersed in it.

With the minute quantity of the conductive particles, such as carbon, which is dispersed in the fluororesin, the releasing layer 11*c* is provided with the resistive value so that it can ground the releasing discharge generated between the trailing end of the recording material P and the surface of the fixing roller 100 to the GND of the apparatus main body through the surface of the pressure roller 110 the moment the trailing end of the recording material P is parted from the fixing roller 100.

The diode element 17 is arranged to connect the core metal 11*a* of the pressure roller 110 and the GND of the apparatus main body. The cathode of the diode element 17 is connected with the core metal 11*a,* and the anode thereof is connected with the GND of the apparatus main body so as not to allow the potential of the core metal 11*a* to present the negative polarity. Then, the potential difference is provided between the surface of the fixing roller 100 and the core metal 11*a* of the pressure roller 110 so that with the electric field thereof, it is arranged to prevent the offset phenomenon from taking place between the recording material P and the fixing roller 100.

Now, as shown in FIGS. 9A to 9D, the aforesaid fixing device allows the unfixed toner or the offset toner described above to adhere to its fixing roller 100 when the image formation is carried out on a specific number of recording sheets. As a result, the toner T1 is accumulated on the surface where the separating claws 14 and the fixing roller 100 are in contact (FIG. 9A).

Then, when the toner T1 is accumulated to a certain extent, it is transferred from the separating claws 14 to the fixing roller 100, and transferred further to the pressure roller 110, hence adhering to the recording material P again as the stained toner T1 (FIGS. 9B, 9C, and 9C).

The transfer of the toner T1 from the separating claws 14 to the fixing roller 100 is a phenomenon that tends to occur more often when the fixing roller 100 begins to rotate, that is, the first run in the morning with the fixing device being in the state of the room temperature or at the actuation in the state on standby. The toner T1 transferred to the fixing roller 100 or the pressure roller 110 is again transferred to the recording material P when the recording material P passes the fixing nip unit N.

The separating claws 14 are aimed at separating the recording material P from the fixing roller 100 exactly. Therefore, it is necessary to arrange a plurality of the separating claws to be in contact with the recording material P in the longitudinal direction of the image area thereof. Also, the contact surface of the separating claws 14 on the fixing roller 100 should be provided with some measures to make the adhesion or accumulation of toner difficult. As such means, the surface layer of each separation claw 14 is coated with PFA, PTFE, or some other fluororesin having an excellent releasability.

Nevertheless, with the excellent releasability which is given to the separating claws 14 alone, it is insufficient to reduce the toner stains that may be allowed to adhere to the recording material P, although there is an effect that the adhesion of toner to or the accumulation thereof on the leading end portion of each separation claw can be reduced.

Also, this phenomenon may lead to the repetition of the cycle of the adhesion of the offset toner to or the accumulation thereof on the separating claws 14, which is peeled off to fall when the fixing roller 100 is actuated, and again its adhesion or accumulation of the offset toner, which is peeled off to fall when the fixing roller 100 is actuated.

This phenomenon does not present any problem for a sheet or two or a continuous printing of several sheets only, because the accumulated amount of toner is minute, and even if it is peeled off from the separating claws 14 to fall and adhere to the recording material P as stains through the fixing roller 100 and the pressure roller 110, the peeled off amount of toner is so small that the resultant stains on the recording material P is not recognized by eye-sight as stains.

However, if a printing is continued for several tens of sheets to several hundreds of sheets, the amount of the accumulated toner becomes greater between the separating claws 14 and the fixing roller 100, and the toner peeled off from the separating claws 14 becomes recognizable by eye-sight on the recording sheet as stains. In this way, the creation of this phenomenon becomes more conspicuous when the printing is continuously made for several tens of sheets or more.

SUMMARY OF THE INVENTION

With a view to solving the problems discussed above, the present invention is designed. It is an object of the invention to provide an image forming apparatus capable of preventing the toner accumulated on the separating claws from being peeled off to fall down to adhere to a recording material even after a continuous image forming is performed.

It is another object of the invention to provide an image forming apparatus wherein at the time of the completion of the continuous image forming to form images on a plurality of recording materials continuously, the heating member is deenergized and the driving is suspended to rotate the rotational members during a first predetermined time period, and subsequently, the heating member is energized and the rotational members are driven to rotate during a second predetermined time period.

It is still another object of the invention to provide an image forming apparatus wherein at the time of the next image forming subsequent to the completion of a continuous image forming to form images on a plurality of recording materials continuously, the time required for energizing the heating member before this image forming, and driving the rotational members to rotate is made longer when the number of recording materials for continuously forming images thereon is greater than the predetermined number of recording materials than when it is smaller.

It is a further object of the invention to provide an image forming apparatus wherein at the time of the next image forming subsequent to the completion of a continuous image forming to form images on a plurality of recording materials continuously, the time required for energizing the heating member before this image forming, and driving the rotational members to rotate is increased corresponding to the increase of the number of recording materials for continuously forming images thereon.

Other objectives of the present invention will be apparent from the following description.

DETAILED DESCRIPTION OF THE PREFERRED EMBODIMENTS

Hereinafter, in conjunction with the accompanying drawings, the description will be made of the embodiments in accordance with the present invention.

Figure 1:
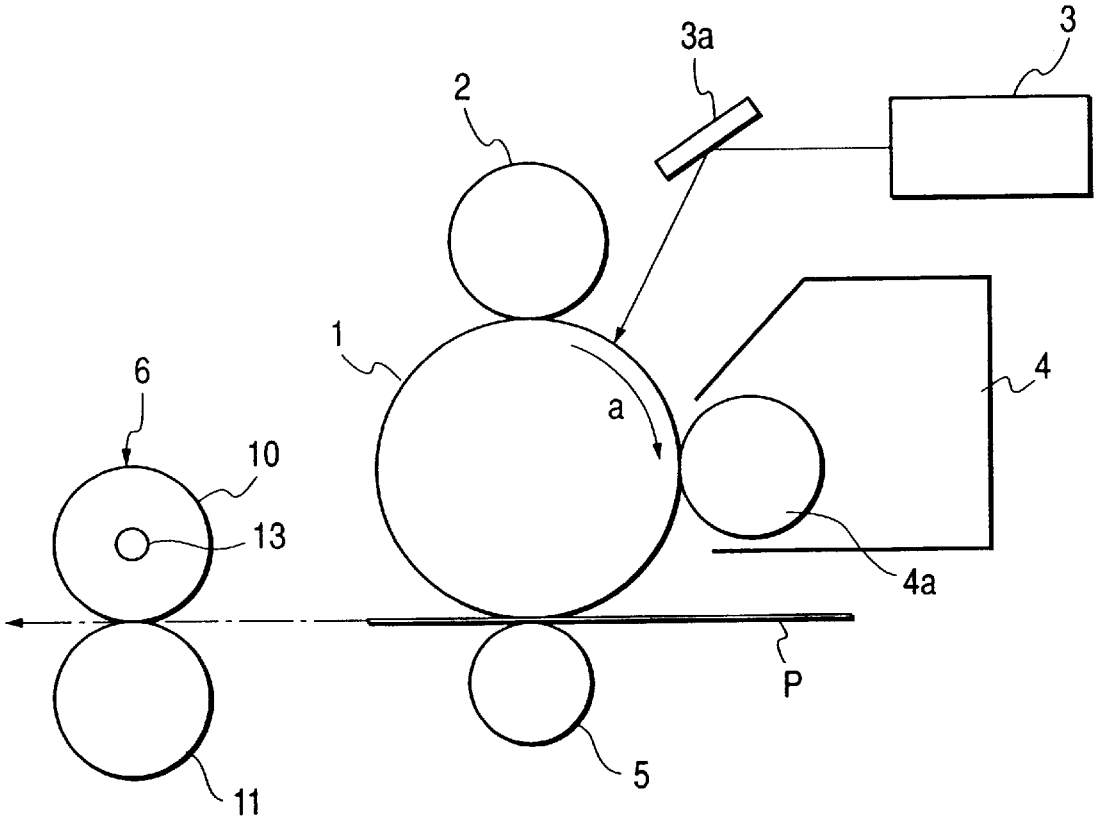
FIG. 1 is a view which schematically shows the structure of the image forming apparatus in accordance with the present invention.

FIG. 1 is a view which schematically shows the structure of the image forming apparatus (a printer of electrophotographic type) in accordance with the present embodiment. In this respect, the image forming apparatus is capable of printing 25 sheets per minute continuously in terms of A4-sized recording material each arranged in the horizontal direction.

In FIG. 1, a reference numeral 1 designates the electrophotographic photosensitive body (hereinafter referred to as a photosensitive body) of rotary drum type which serves as the image bearing member; 2, a charging roller; 3, an exposing device; 4, a developing device; 5, a transferring roller; and 6, a fixing device.

The photosensitive body 1 is provided with a photosensitive layer (not shown) on the drum base (not shown) formed by aluminum which is the negatively charged organic photosensitive body in accordance with the present embodiment, and is arranged to rotate at a specific process speed in the direction indicated by an arrow a in FIG. 1. In the rotational process, the photosensitive body is charged uniformly by use of the charging roller 2 with the negative polarity.

The charging roller 2 is in contact with the surface of the photosensitive body 1 under a specific pressure to rotate following the driving rotation of the photosensitive body 1. Then, a predetermined charging bias is applied to the charging roller 2 from the charging bias supply source (not shown) in order to charge the photosensitive body 1 at a predetermined polarity and electric potential.

The exposing device 3 forms the electrostatic latent images on the charged photosensitive body 1 by performing the exposure through the reflection mirror 3*a* by the irradiation of laser beam or LED beam in accordance with the inputted image information.

The developing device 4 is the inverted development device provided with the development sleeve 4*a*. To the development sleeve 4*a,* a predetermined developing bias is applied from the developing bias supply source (not shown).

The transferring roller 5 is in contact with the surface of the photosensitive body under a specific pressure to rotate following the driving rotation of the photosensitive body 1, and a specific transferring bias is applied to it from the transferring bias supply source (not shown). Means for forming unfixed images comprises the photosensitive body 1, the charging roller 2, the exposing device 3, the developing device 4, and the transferring roller 5, among some others.

Figure 8:
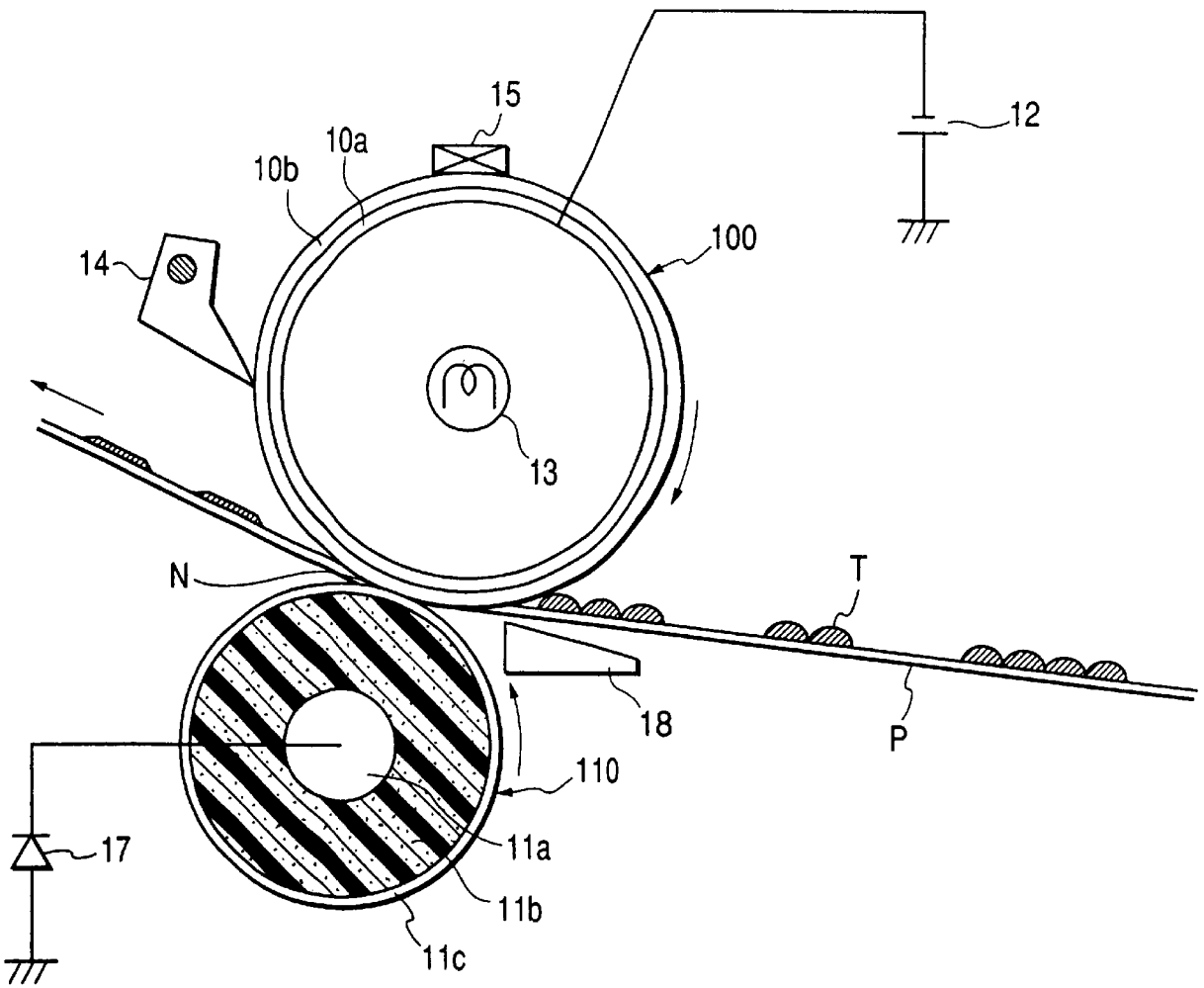
FIG. 8 is a view which schematically shows the structure of the fixing device which is a related art of the present invention.
Figure 9A:
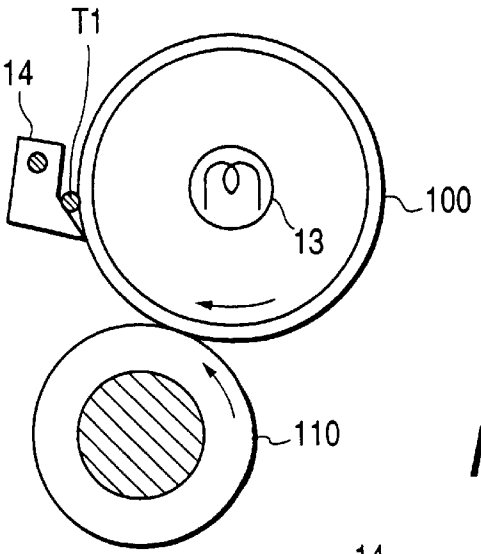
FIGS. 9A, 9B, 9C and 9D are views which illustrate the occurrence of image stains by use of the separating claws.
Figure 9B:
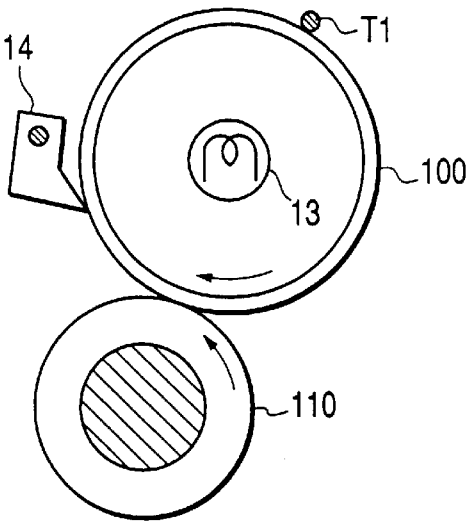
Figure 9C:
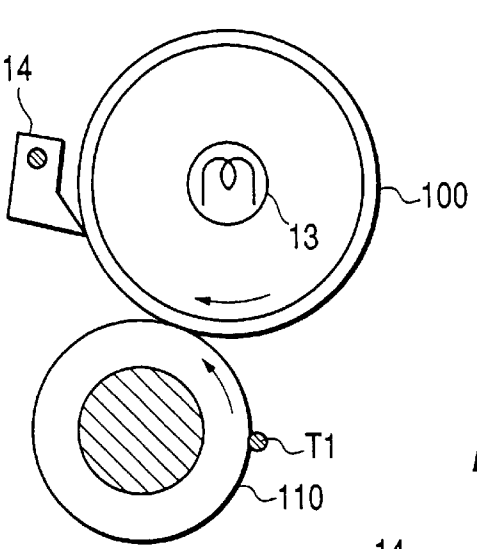
Figure 9D:
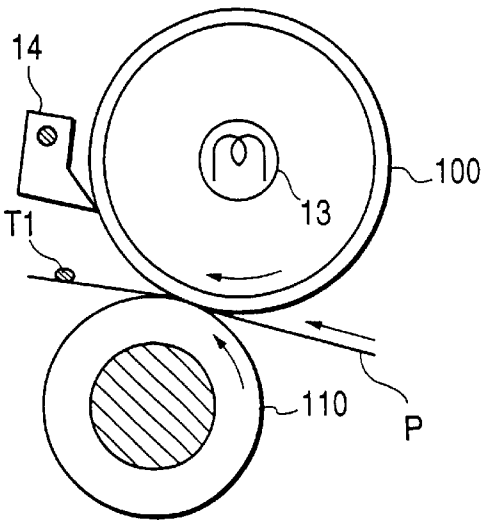

The fixing device 6 is provided with a fixing roller 10 in the form of drum which is rotatively supported, and a pressure roller 11. In the fixing roller 10, a heater 13 is arranged (the detailed structure of the fixing device 6 will described later. Here, the description will be made of the same members by applying the same reference marks as those appearing in the description of the fixing device in conjunction with FIG. 8). The heater may be arranged for the pressure roller or arranged both for the fixing roller and the pressure roller.

Now, the description will be made of the image forming operation of the image forming apparatus described above.

When forming images, the photosensitive body 1 is driven by driving means (not shown) to rotate at a specific process speed in the direction indicated by an arrow a, and charged uniformly with the negative polarity by use of the charging roller 2 charged with the charging bias.

Then, the exposure is given by the exposing device 3 with the laser beam or the LED beam to the charged surface of the photosensitive body 1 through the reflection mirror 3*a,* thus forming the electrostatic latent images in accordance with the inputted image information. After that, the electrostatic latent images are developed by means of the development sleeve 4*a* to which the developing bias is applied, and the images are made visible as the toner images.

When the toner images on the surface of the photosensitive body 1 arrive at the transfer nip between the transferring roller 5 and the photosensitive body 1, a recording material P is carried to the transfer nip at the timing which matches this arrival. Then, the toner images are transferred by use of the transferring roller 5 to which the transferring bias is applied. The recording material P having the transferred toner images on it is carried to the fixing device 6 where the unfixed toner images are fixed on the recording material P by heating under pressure on the fixing nip unit between the fixing roller 10 and the pressure roller 11, and exhausted to the outside subsequently.

Now, the detailed structure of the fixing device 6 will be described in accordance with the present embodiment.

Figure 2:
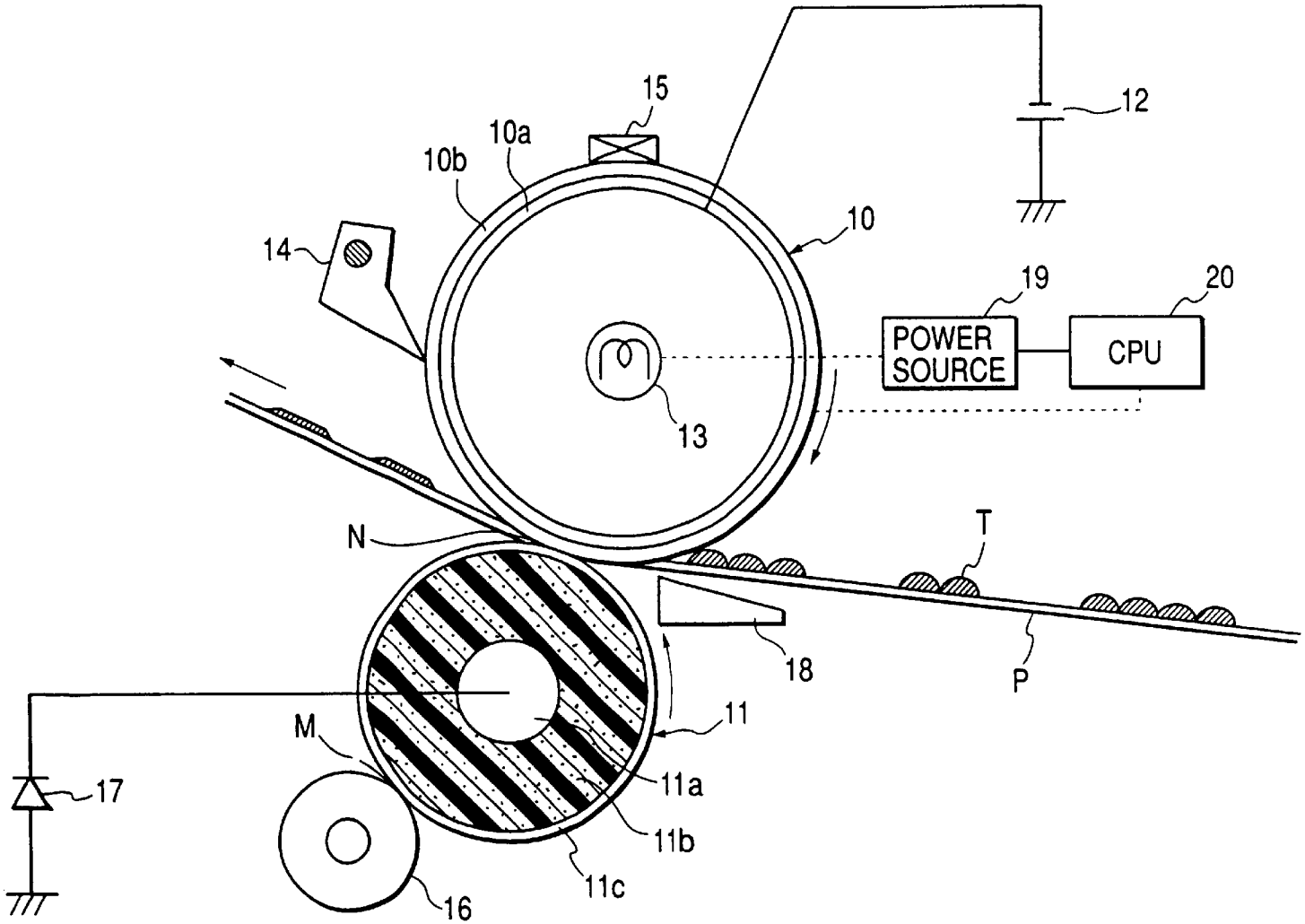
FIG. 2 is a view which schematically shows the structure of the fixing device in accordance with the present invention.

FIG. 2 is a view which schematically shows the structure of the fixing device 6 of the present embodiment. As shown in FIG. 2, the pressure roller 11 is pressed to the fixing roller 10 by pressing means (not shown) to form the fixing nip unit N. The recording material P having the unfixed toner images transferred to the surface thereof is carried through the guide member 18 to the fixing nip unit N between the fixing roller 10 and the pressure roller 11 which are driven to rotate, and then, the recording material P is pinched and carried by the fixing nip unit N.

The fixing roller 10 which a rotational member is provided with the releasing layer 10*b* formed by a PFA tube in a thickness of 50 $\mu$m as the releasing layer 10*b* on the core metal 10*a* of 40 mm diameter formed by aluminum in a thickness of 1 mm. When the fixing bias of −700 V is applied to the core metal 10*a* of the fixing roller 10 from the DC supply source 12, the surface potential of the fixing roller 10 is kept at approximately −650V, hence giving the potential difference to prevent offset between the fixing roller 10 and the pressure roller 11.

With the heater 13 which is a heating member in the fixing roller 10, the supply source 19 and the controlling device (CPU) 20 are connected. Then, the controlling device 20 controls the on and off of the current to the heater 13 so that the surface temperature of the fixing roller 10 is kept at a constant level on the basis of the surface temperature information detected by the thermistor 15 arranged on the surface of the fixing roller 10. Also, the controlling device 20 controls the on and off of the current to the heater 13, as well as controls the driving of the fixing roller 10 and the pressure roller 11 to rotate (these controls will be described later).

For the surface of the fixing roller 10, a plurality of separating claws 14 (six claws, for example) are arranged in the longitudinal direction thereof, and the structure is arranged so that variously sized recording materials can be separated accordingly.

The pressure roller 11 which is a rotational member is structured by the formation of the elastic layer 11*b* of silicon sponge rubber in a thickness of 8 mm on the iron core metal 11*a* of 14 mm diameter, further with the formation of the releasing layer 11*c* on the elastic layer 11*b*. The releasing layer 11*c* is formed by covering the conductive PFA tube in a thickness of 50 $\mu$m which contains carbon in the fluororesin in a weight ratio of 5 to 8%. Also, the hardness of the pressure roller 11 is set at approximately 54 degrees (one kg load of the Asker C hardness meter), and then, the roller is pressed to the fixing roller 10 under a pressure of 200 N to provide the fixing nip unit N in a width of 5.5 mm.

Between the core metal 11*a* of the pressure roller 11 and the GND of the apparatus main body, the cathode of the diode element 17 having a pressure resistance of 2 kV is connected with the core metal 11*a* side, and the anode thereof is connected with the GND side of the apparatus main body, hence holding the surface of the pressure roller 11 with the positive potential.

The cleaning roller 16, which is a cleaning member rotatively in contact with the pressure roller 11, is formed with the solid aluminum whose outer diameter is 14 mm $\phi$, and arranged to rotate following the driving rotation of the pressure roller 11. The contact between the cleaning roller 16 and the pressure roller 11 is such that the cleaning roller 16 bites the pressure roller 11 by approximately 0.7 mm to obtain the cleaning nip M of approximately 1.5 mm by setting the distance between the axial centers at 21.3 mm between the core metal 11*a* of the pressure roller 11 and the core metal of the cleaning roller 16. The cleaning member may be arranged either for the fixing roller or both for the fixing roller and the pressure roller.

Also, in the apparatus main body (not shown), a cassette (not shown) is arranged to store recording materials P. A cassette is capable of storing 500 sheets if the basis weight of the recording material P is 80 g/m$^2$ or less, and two of them are arranged in a double-deck fashion.

With the image forming apparatus provided with the fixing device which is structured as described above, an examination is made to ascertain the relationship between the staining condition of the separating claws 14 and the number of sheet continuously printed at the time of a continuous printing (that is, a continuous image forming where images are formed continuously on a plurality of recording materials in accordance with one-time image formation signal). The result of such examination is shown on the Table 1 given below. Here, the following method is adopted to confirm the staining condition between the separating claws 14 and the recording materials P: each of the listed numbers of the LASER 80 (A4-size, 80 g/m$^2$ manufactured by Canon) which contains approximately 19% calcium carbonate as filler is continuously printed as designated on the Table 1 accordingly, and then, after the completion of the image forming operation, each one of the printed sheets is used for printing at sufficient intervals to confirm the stains created by use of the separating claws 14 on each of the recording materials P.

TABLE 1

| Number of Sheets Continuously Fed | Stains on the Recording Materials by Use of Separating claws |
|---|---|
| 10 | 0/6 |
| 20 | 0/6 |
| 30 | 0/6 |
| 40 | 0/6 |
| 50 | 0/6 |
| 60 | 0/6 |
| 70 | 1/6 |
| 100 | 2/6 |
| 150 | 2/6 |
| 200 | 2/6 |
| 250 | 4/6 |
| 300 | 4/6 |
| 400 | 4/6 |
| 500 | 4/6 |

On the Table 1, the "stains on the recording materials by use of separating claws" indicates the number of locations where the stains are recognized out of the six separations claws used, respectively.

As clear from the result shown on the Table 1, the strains are caused by the separating claws 14 when the number of the sheets exceeds 70 in the continuous printing. Then, it is observable that stains tend to become worse as the number of continuous sheet printing becomes larger.

Now, therefore, in accordance with the present embodiment, the controlling device 20 is arranged to suspend the rotational operation of the fixing roller 10 and the pressure roller 11, and then, to cut off the current from the supply source 19 to the heater 13 for a predetermined period of time t1 after the completion of image forming operation when the continuous sheet printing should exceed a predetermined condition. By turning off the current to the heater 13, the temperature of the adhering and accumulating toner of the separating claws 14 is lowered than the temperature during the image forming to make it easier for the toner to be peeled off to fall by means of vibration or the like when the next rotational driving is initiated.

Then, the fixing roller 10 and the pressure roller 11 of the fixing device 6 are driven to rotate during a predetermined period of time t2. Thus, the toner which is peeled off from the separating claws 14 to fall on the fixing roller 10 is collected by the cleaning roller 16 by way of the fixing roller 10 and the pressure roller 11.

Now, hereunder, the detailed description will be made of the toner collecting operation in accordance with the present invention.

At first, in a case where the creation of stains caused by the separating claws 14 becomes worst, and the number of continuously printed sheets is set at 500, the studies are made to find a predetermined time period t1 that makes it easier for the toner to be peeled off from the separating claws 14 to fall down. The results are shown on the Table 2 given below. The results are obtained by each one of the recording materials is printed after the time period t1.

TABLE 2

| Predetermined Time Period t1 (Seconds) | Stains on Recording Material by Use of Separating claws |
|---|---|
| 0 | 0/6 |
| 1 | 0/6 |
| 2 | 0/6 |
| 3 | 0/6 |
| 4 | 0/6 |
| 5 | 0/6 |
| 6 | 0/6 |
| 7 | 0/6 |
| 8 | 0/6 |
| 9 | 0/6 |
| 10 | 1/6 |
| 11 | 0/6 |
| 12 | 2/6 |
| 13 | 4/6 |
| 14 | 2/6 |
| 15 | 2/6 |

On the Table 2, the "stains on recording material by use of separating claws" indicates number of locations where the toner is peeled off to fall out of the six separating claws used, respectively.

As clear from the results shown in the Table 2, it is preferable to turn off the current to the heater in a state where the fixing roller 10 and the pressure roller 11 of the fixing device 6 are not allowed to rotate 10 seconds or more in order to make it easier for the separating claws 14 to peel off the adhering and accumulating toner thereof to fall after the continuous printing of 500 sheets. This is because the temperature of the adhering and accumulating toner of the separating claws 14 is made lower than the printing temperature of the continuously printed sheets by turning off the current to the heater 13 in the condition where the rotation of the fixing roller 10 and pressure roller 11 is suspended for a period of 10 seconds or more, hence easily peeling off the adhering and accumulating toner of the separating claws 14 to fall down.

Then, with the 10 seconds obtained from the Table 2 being given as the predetermined time period t1, it is attempted to confirm the effect of a predetermined time period t2 at which the fixing roller 10 and the pressure roller 11 are allowed to rotate subsequent to the printing of such predetermined time period of t1, that is, 10 seconds.

This method of confirmation is such that after the completion of the continuous printing of 500 sheets, the rotation of the fixing roller 10 and pressure roller 11 is suspended for a period of 10 seconds, and the heater 13 is deenergized in such state to make it easier to peel off the adhering and accumulating toner of the separating claws 14 to fall down, and that when the rollers are allowed to rotate next time, the toner that has fallen off from the separation claws 14 is collected to the cleaning roller 16 by way of the fixing roller 10 and the pressure roller 11 as described earlier, and then, it is confirmed whether or not the stains are created on the recording material P by changing the rotational period (a predetermined time period time t2) during which the fixing roller 10 and the pressure roller 11 are allowed to rotate. Here, while these rollers rotate, the heater 13 is energized. The results thereof are shown on the Table 3 given below. Each of the results is obtained by printing one sheet of the recording material after the elapse of the time t2.

TABLE 3

| Predetermined Time Period t2 (seconds) | Stains on Recording Material by Use of Separating claws |
|---|---|
| 0 | 5/6 |
| 1 | 4/6 |
| 2 | 2/6 |
| 3 | 3/6 |
| 4 | 2/6 |
| 5 | 2/6 |
| 6 | 0/6 |
| 7 | 1/6 |
| 8 | 0/6 |
| 9 | 0/6 |
| 10 | 0/6 |
| 11 | 0/6 |
| 12 | 0/6 |
| 13 | 0/6 |
| 14 | 0/6 |
| 15 | 0/6 |

On the Table 3, the "stains on recording material by use of separating claws" indicates number of locations where the toner is not collected out of the six separating claws used, respectively.

As clear from the Table 3, if the rotational time (the predetermined time period t2) during which the fixing roller 10 and the pressure roller 11 are allowed to rotate is set at 8 seconds or more, the peeled and fallen off toner from the separating claws 14 is collection by the cleaning roller 16 in good condition when the adhering and accumulating toner of the separating claws 14 is peeled off from the separating claws 14 to fall down and collected by the cleaning roller 16 through the fixing roller 10 and the pressure roller 11. Hence, there is no possibility that the fallen off toner appears on the recording material as stains.

In this respect, the reason why the heater 13 is energized is that the toner that has fallen off from the separating claws 14 is prevented from being solidified on the surface of the fixing roller 10 and pressure roller 11 so that the cleaning roller 16 should be able to collect it.

Figure 3:
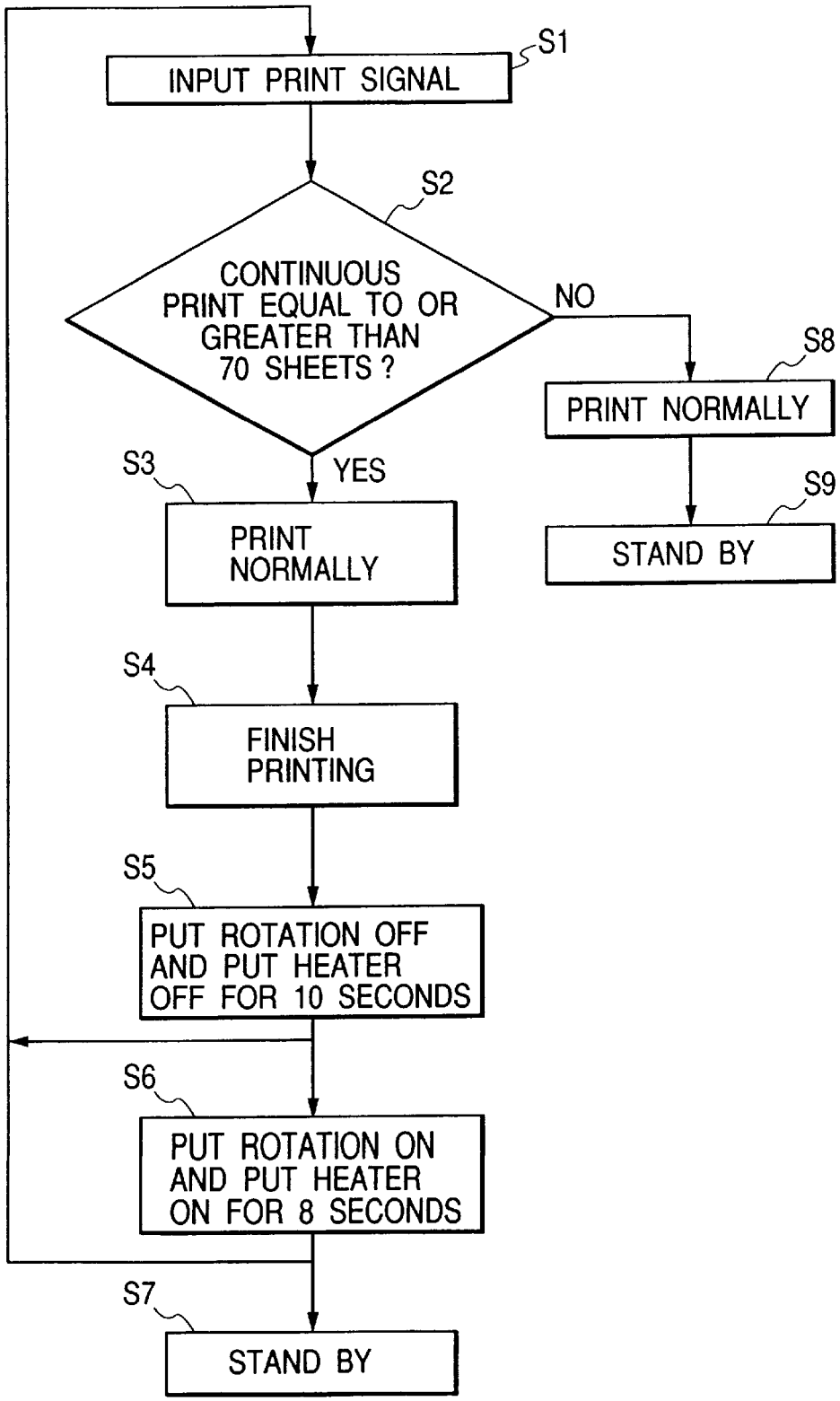
FIG. 3 is a flowchart which shows the collecting operation of the adhering and accumulating toner of the separating claws in accordance with the present invention.

Now, with reference to the flowchart shown in FIG. 3, the description will be made of the collecting operation (cleaning operation) of the adhering and accumulating toner of the separating claws 14 in accordance with the present embodiment.

Figure 4:
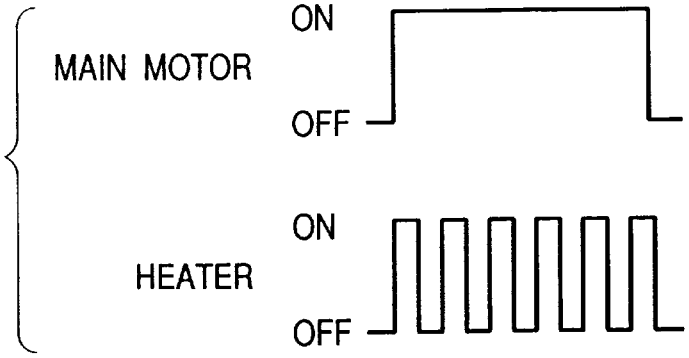
FIG. 4 is a view which shows the on and off of the main motor which drives the fixing roller and pressure roller to rotate at the time of usual printing, as well as the on and off of the heater, in accordance with the present invention.

At first, in step S1, the printing signal is inputted. If a continuous printing of 70 sheets or more should be executed, the usual printing (image forming) operation is executed as described earlier (steps S2 and S3). Here, as shown in FIG. 4, the main motor is turned on to drive the fixing roller 10 and the pressure roller 11 to rotate. The on and off of the current to the heater 13 is controlled to keep the surface temperature of the fixing roller 10 at a constant level.

Figure 5:
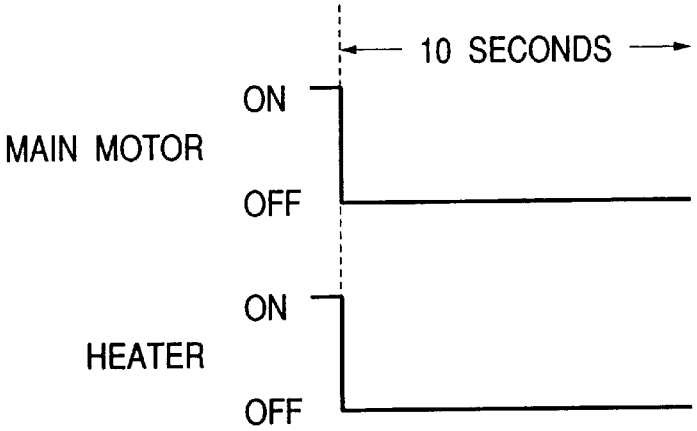
FIG. 5 is a view which shows the on and off of the main motor which drives the fixing roller and pressure roller to rotate, as well as the on and off of the heater, in accordance with the present invention.

Then, after the completion of the printing operation (step S4), the rotational operation of the fixing roller 10 and pressure roller 11 is suspended for a period of 10 seconds. The heater 13 is deenergized (step S5). At this juncture, as shown in FIG. 5, the main motor that drives the fixing roller 10 and pressure roller 11 to rotate is turned off, and the current to the heater 13 is also turned off.

Figure 6:
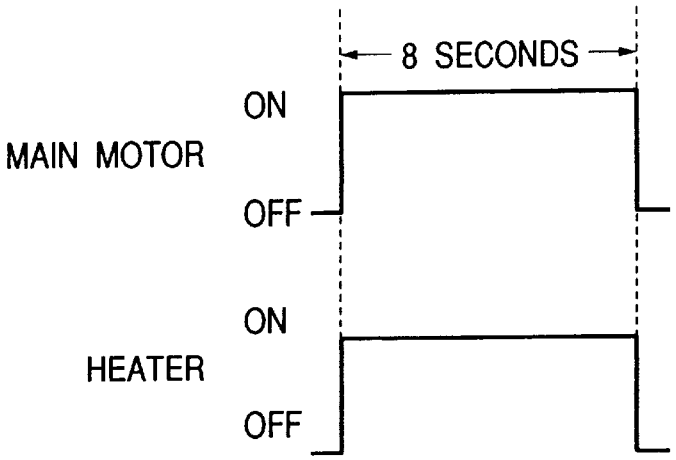
FIG. 6 is a view which shows the on and off of the main motor which drives the fixing roller and pressure roller to rotate, as well as the on and off of the heater, in accordance with the present invention.

Then, after the operation in the step S5, the fixing roller 10 and pressure roller 11 are allowed to rotate for a period of 8 seconds, and the heater 13 is energized to be on standby (steps S6 and S7). At this juncture, as shown in FIG. 6, the main motor that drives the fixing roller 10 and pressure roller 11 to rotate is turned on. The current to the heater 13 is also turned on.

Also, if the continuous printing is not carried out for 70 sheets or more in the step S2, the process returns to be on standby subsequent to having performed the usual printing (image forming) operation as described above (steps S8 and S9).

In accordance with the present embodiment, when the printing is continued for 70 sheet or more, the rotation of the fixing roller 10 and pressure roller 11 of the fixing device 6 is suspended for a period of 10 seconds (the first predetermined time period) after the completion of this continuous printing of 70 sheets or more, and the heater 13 is deenergized. In this way, the adhering and accumulating toner of the separating claws 14 is made easier to be peeled off to fall down. After the 10-second suspension, the fixing roller 10 and pressure roller 11 are allowed to rotate for a period of 8 seconds (the second predetermined time period), and the heater 13 is also energized. Thus, the peeled and fallen off toner is collected to the cleaning roller 16. In this manner, it becomes possible to prevent the adhering and accumulating toner of the separating claws 14 from falling off to appear on the recording material P as stains.

In accordance with the present embodiment, if the printing should be continued for 70 sheets or more, the rotation of the fixing roller 10 and pressure roller 11 of the fixing device 6 is suspended and the heater 13 is deenergized once for a period of 10 second uniformly, and then, the fixing roller 10 and pressure roller 11 are driven to rotate for a period of 8 second, while the heater 13 is energized as described above. However, it may be possible to execute a control of the kind in steps depending on the number of sheets which should be printed continuously.

Also, even in the case of the continuous printing of 70 sheets or more, it may be possible to peel off the toner from the separating claws 14 by making the predetermined time period (during which the rotation of the fixing roller 10 and pressure roller 11 is suspended, and the heat 13 is deenergized) t1 shorter if the numbers of printed sheets are not many, and then, the cleaning time may be shortened.

Also, for the continuous printing of 70 sheets and that of 300 sheets, the stains of the separating claws 14 become worse in the case of 300-sheet printing as shown in the Table 1. This is because as compared with the 70-sheet printing, the amount of the offset toner which becomes the adhering and accumulating toner of the separating claws 14 is larger for the 300-sheet printing. Therefore, it is preferable to make the predetermined time period t1 longer as the number of the sheets continuously printed becomes larger.

Also, in comparison between the 70-sheet continuous printing and the 300-sheet one, the amount of adhering and accumulating toner of the separating claws 14 is smaller for the 70-sheet case. Therefore, it is possible to collect the fallen off toner from the separating claws 14 by use of the cleaning roller 16 through the fixing roller 10 and pressure roller 11 even if the aforesaid predetermined time period t2

(during which the fixing roller 10 and pressure roller 11 are driven to rotate, and the heater 13 is energized) is made shorter after the elapse of the predetermined time period t1.

In this way, even in the case of a continuous printing of a specific number of sheets or more, it is possible to collect the adhering and accumulating toner of the separating claws 14 in good condition with a shorter period of the predetermined time period t1 and that of the predetermined time period t2, if the number of sheets continuously printed. If the number of sheets continuously printed is may, it is also possible to collect the adhering and accumulating toner of the separating claws 14 in good condition by making the predetermined time period t1 and the predetermined time period t2 longer. In other words, it is preferable to make the predetermined time period t1 and the predetermined time period t2 longer as the number of sheets that should be printed continuously is made larger.

Also, in accordance with the present invention, it is made possible to collect the adhering and accumulating toner of the separating claws 14 in good condition by securing the predetermined time period t1 and the predetermined time period t2 when a certain specific number of sheets are to be printed continuously. However, it is possible to suspend the toner collecting operation of the present invention immediately when the next printing signal is inputted between the predetermined time period t1 and the predetermined time period t2 or to suspend it and shift the operation to the image forming so that the user of the image forming apparatus is not affected at all. In this case, however, the collection of the adhering and accumulating toner of the separating claws 14 is suspended on the way, and it may become difficult to collect the adhering and accumulating toner of the separation craws 14 in good condition depending on the situations.

In contrast, if the operation shifts to the next image forming after the completion of the toner collecting operation of the present invention, the adhering and accumulating toner of the separating claws 14 can be collected in good condition, although it may take slightly longer for the user to receive the recording material P having the toner images transferred and fixed on it, which is exhausted to the outside.

It is the user who selects and puts priority on the printing efficiency and printing time or on the quality of the printed images. Here, however, such selection is made possible in the manner described above so as to meet the user's requirements.

Now, in accordance with the embodiment described above, the cleaning operation is executed if the continuous printing exceeds a specific number of sheets. However, it may be possible to make an arrangement for the continuous printing so that the cleaning operation can be executed at any time when the stains become conspicuous even for the printing of several sheets irrespective of the number of sheets set for that particular operation.

Now, the description will be made of another embodiment in accordance with the present invention. For the present embodiment, the fixing device of the same structure as that of the embodiment described in conjunction with FIG. 2 is used, and the description will be made using the fixing device shown in FIG. 2.

For the present embodiment, it is arranged to energize the heater 13 for the preparation of fixing images when the next printing signal is inputted in a state where the adhering and accumulating toner of the separating claws 14 becomes impossible to be collected in good condition with the continuously printed sheets which has exceeded a specific number of sheets as described for the previous embodiment, and then, the operating time of the pre-rotation, which will be described later, is made longer in order to peel off the adhering and accumulating toner of the separating claws 14 by means of the vibration or the like when the rotation of the fixing roller 10 and pressure roller 11 is initiated, hence collecting the fallen off toner by use of the cleaning roller 16 through the fixing roller 10 and the pressure roller 11 as described above.

The aforesaid pre-rotational operation is a series of operations to prepare for fixing images when the printing signal is inputted. Here, in order to shift the fixing device on standby to be ready for fixing images, the heater 13 is energized to raise the temperature of the fixing roller 10, and at the same time, the fixing roller 10 is allowed to rotate, hence enabling the temperature of the pressure roller 11 to rise to a specific level. When the temperature of the pressure roller 11 arrives at the specific level in the pre-rotational operation, the recording material P having the unfixed toner images on it is carried to the fixing nip unit N between the fixing roller 10 and the pressure roller 11 of the fixing device 6.

The present embodiment is the controlling operation immediately before the image forming operation with the input of the printing signal as described above. Here, it takes longer than usual before the recording material P having the fixed toner images on it is exhausted to the outside.

Therefore, in accordance with the present embodiment, the extended time required for the execution of the pre-rotational operation is determined prior to the next image forming by the controlling device 20 depending on the number of sheets continuously printed in the last printing operation. By the control of the time required for the pre-rotational by use of the controlling device 20, it becomes possible to minimize the extended time before the recording material P having the fixed toner images on it is exhausted to the outside. In this manner, within the minimized time before the recording material P having the transferred and fixed toner images on it is exhausted, the arrangement is made to collect the adhering and accumulating toner of the separating claws 14.

In this respect, the examination is made on the relationship between the staining condition of the separating claws 14 with respect to the pre-rotational extended time (0 to 12 seconds), and the number of continuously printed sheets at the time of the continuous printing (continuous image forming) in accordance with the present embodiment. The results are obtained as shown in the Table 4 given below. Here, the following method is adopted to confirm the staining condition between the separating claws 14 and the continuously printed sheets of the recording materials P at that time: each of the listed numbers of the LASER 80 (A4-size, 80 g/m$^2$ manufactured by Canon) which contains approximately 19% calcium carbonate as filler is continuously printed, and then, after the completion of the image forming operation, each one of the printed sheets is used for printing subsequent to the execution of the pre-rotational operation to confirm the stains created by use of the separating claws 14 on each of the recording materials P.

TABLE 4

| Seconds / Sheets | 0 | 1 | 2 | 3 | 4 | 5 | 6 | 7 | 8 | 9 | 10 | 11 | 12 |
|---|---|---|---|---|---|---|---|---|---|---|---|---|---|
| 50 | ○ | ○ | ○ | — | — | — | — | — | — | — | — | — | — |
| 60 | ○ | ○ | ○ | ○ | ○ | — | — | — | — | — | — | — | — |
| 70 | Δ | ○ | Δ | ○ | ○ | ○ | ○ | ○ | — | — | — | — | — |

TABLE 4-continued

| Seconds / Sheets | 0 | 1 | 2 | 3 | 4 | 5 | 6 | 7 | 8 | 9 | 10 | 11 | 12 |
|---|---|---|---|---|---|---|---|---|---|---|---|---|---|
| 100 | Δ | Δ | Δ | ○ | Δ | ○ | ○ | ○ | ○ | ○ | — | — | — |
| 150 | Δ | Δ | Δ | Δ | Δ | ○ | ○ | ○ | ○ | ○ | ○ | ○ | ○ |
| 200 | X | Δ | Δ | Δ | Δ | Δ | ○ | ○ | ○ | ○ | ○ | ○ | ○ |
| 250 | X | X | Δ | X | Δ | Δ | Δ | Δ | ○ | ○ | ○ | ○ | ○ |
| 300 | X | X | X | Δ | Δ | Δ | Δ | Δ | ○ | ○ | ○ | ○ | ○ |
| 400 | X | X | X | Δ | X | Δ | Δ | Δ | ○ | ○ | ○ | ○ | ○ |
| 500 | X | X | Δ | X | Δ | X | X | Δ | ○ | ○ | ○ | ○ | ○ |

In the Table 4, the mark ○ indicates those having no stains; the mark α indicates that the stains are created on one to two separating claws out of the six separating claws; the mark x indicates that the stains are created on three or more separating claws out of the six separating claws; and the mark—indicates those not examined yet.

As clear from the Table 4, if the continuously pinted sheet numbers are less than 70, there is no creation of stains by use of the separating claws 14. If the continuously printed sheet numbers are equal to or more than 70, the staining condition of the separating claws 14 becomes worse as the number of the continuously printed sheets is increased. It is then understandable that unless the extended time required for the pre-rotational operation is made longer, it becomes impossible to prevent the stains from being created by use of the separating claws 14.

On the basis of the results shown in the Table 4, it becomes possible to prevent the separating claws 14 from being stained, and at the same time, to suppress the extension of the printing time to the minimum by setting the number of continuously printing sheets and the extended time required for the pre-rotational operation as per the Table 5 in accordance with the present embodiment.

TABLE 5

| Continuously Printed Numbers (sheets) | Extended Time Required for Pre-rotation (seconds) | Stains on Separating claws |
|---|---|---|
| 1–69 | 0 | ○ |
| 70–99 | 5 | ○ |
| 100–199 | 6 | ○ |
| 200–299 | 7 | ○ |
| 300– | 9 | ○ |

Figure 7:
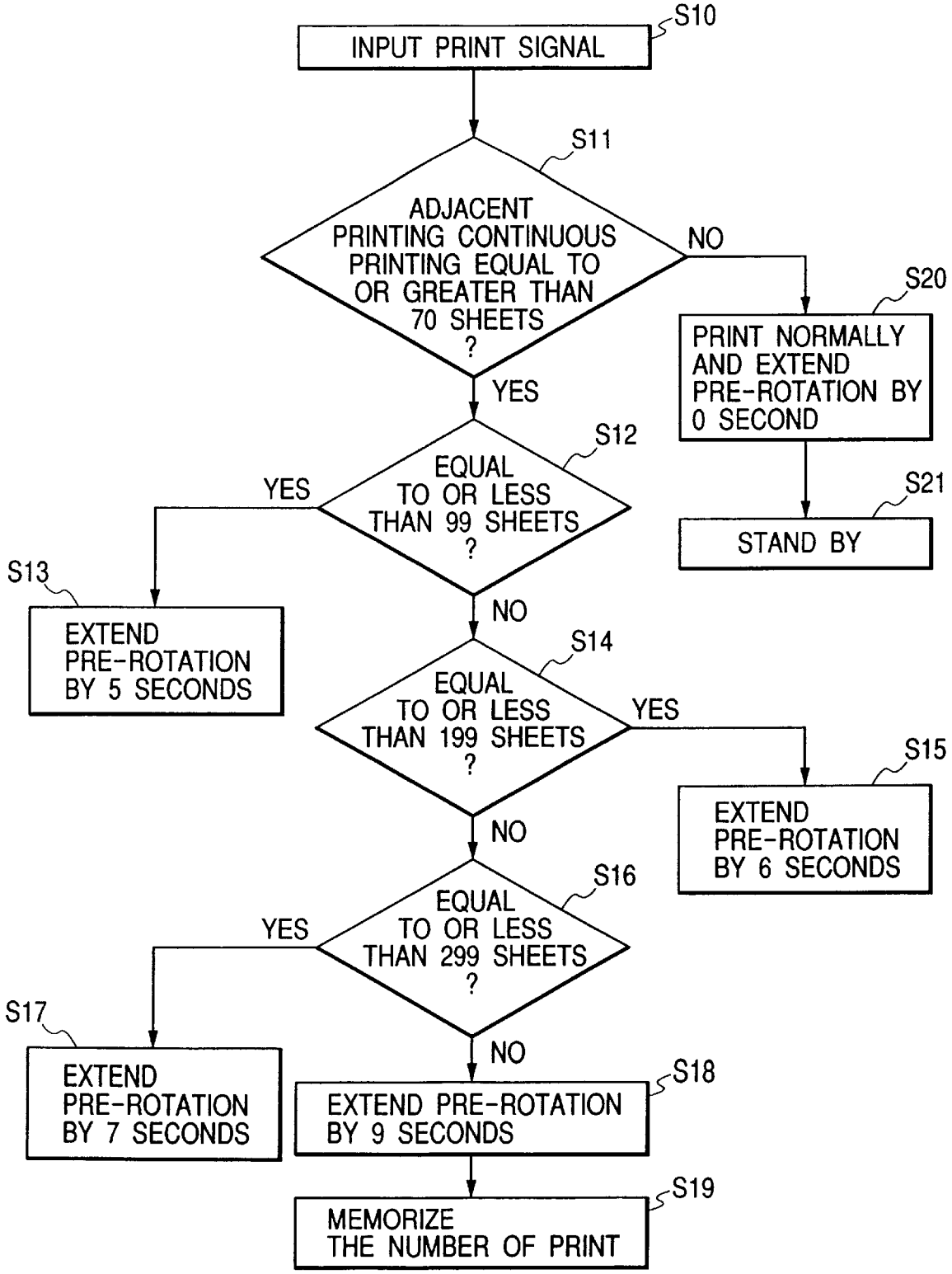
FIG. 7 is a flowchart which shows the collecting operation of the adhering and accumulating toner of the separating claws in accordance with the present invention.

Now, with reference to the flowchart shown in FIG. 7, the description will be made of the collecting operation of the adhering and accumulating toner of the separating claws 14 by the extension of the time required for the pre-rotational operation as shown in the Table 5 in accordance with the present embodiment.

At first, in step S10, the printing signal is inputted. If the last printing is the continuous 70 or more (step S11), the aforesaid pre-rotational operation is extended longer than usual by 5 seconds (step S12 and step S13) provided that the continuously printing number is 99 sheets or less.

Then, in step S12, if the continuously printing number is equal to or more than 99, the aforesaid pre-rotational operation is extended more than usual by 6 seconds (steps S14 and S15) provided that the continuously printing number is 199 or less.

Then, in step S14, if the continuously printing number is equal to or more than 199, the aforesaid pre-rotational operation is extended more than usual by 7 seconds (steps S14, 16, and S17) provided that the continuously printing number is 299 or less. Then, in step S16, if the continuously printing number is equal to or more than 299, the aforesaid pre-rotational operation is extended more than usual by 9 seconds and the printing sheet numbers are stored (steps S16, S18, and S19).

Also, in step S11, if the last printing is not the continuous one for 70 sheets or more, the aforesaid pre-rotational operation is not extended, and the usual printing (image forming) is executed as described above. After that, the operation returns to be on standby (step S20 and step S21).

In other words, in accordance with the present embodiment, when the next image forming is executed subsequent to the completion of the continuous image forming, the time required for energizing the heating member before the intended image formation, as well as for driving the rotational member to rotate, is made longer in the case where the number of recording materials for the continuous image forming is greater than the predetermined number of recording materials than in the case where it is smaller.

Also, in accordance with the present embodiment, when the next image forming is executed subsequent to the completion of the continuous image forming, the time required for energizing the heating member before the intended image formation, as well as for driving the rotational member to rotate, is increased corresponding to the increase of the number of the recording materials on which the images are formed continuously.

As described above, in accordance with the present embodiment, if the last printing is the continuous one and the continuously printed sheet number is 70 or more, the time required for the pre-rotation which is the preparatory operation of the image fixation is extended corresponding to the continuously printed sheet numbers so as to peel off the adhering and accumulating toner of the separating claws 14 to drop down from the separating claws 14, which is collected by the cleaning roller 16 by way of the fixing roller 10 and the pressure roller 11 as described above. Hence, the collection of the adhering and accumulating toner of the separating claws 14 is performed in good condition.

In this respect, although the present invention has been described with reference to the specific embodiments, it is not meant to be construed in a limiting sense. Various modifications of the disclosed embodiments, as well as other embodiments of the invention, will become apparent with reference to the description of the invention. It is therefore contemplated that the appended claims will cover any modifications as fall within the true scope of the invention.

What is claimed is:

1. An image forming apparatus comprising:

unfixed image forming means for forming unfixed images;

fixing means for fixing the unfixed images formed by said unfixed image forming means on a recording material, wherein said fixing means includes a first rotational member and a second rotational member for pinching and conveying the recording material bearing the unfixed images thereon, a heating member for generating heat by supplying power and heating said first rotational member, a separating member for separating the recording material from said first rotational member, and a cleaning member for cleaning said second rotational member; and controlling means for turning off the power supply to said heating member and rational diving of said first rotational member and said second rotational member for a first predetermined time period when continuous image forming for continuously forming images on a plurality of recording materials is completed, and subsequently turning on the power supply to said heating member and rotational driving of said first rotational member and said second rotational member for a second predetermined time period.

2. An image forming apparatus according to claim 1, wherein said first predetermined time period and said second predetermined time period are changed in accordance with the number of recording materials continuously having images formed thereon.

3. An image forming apparatus according to claim 2, wherein said first predetermined time period and said second predetermined time period are both increased in accordance with an increase in the number of recording materials for continuously having images formed thereon.

4. An image forming apparatus according to claim 1, wherein said first rotational member is a fixing roller, and said heating member is provided in the interior of said fixing roller, and said separating member is in contact with said fixing roller, and said second rotational member is a pressure roller, said cleaning member being in contact with said pressure roller.

5. An image forming apparatus according to claim 1, wherein said controlling means is actuated when the number of recording materials for continuously having images formed thereon is greater than a predetermined number of recoding materials.

6. An image forming apparatus comprising:

unfixed image forming means for forming unfixed images; and fixing means for fixing the unfixed images formed by said unfixed image forming means on a recording material, wherein said fixing means includes a first rotational member and a second rotational member for pinching and conveying the recording material bearing the unfixed images thereon, a heating member for generating heat by supplying power and heating said first rotational member, a separating member for separating the recording material from said first rotational member, and a cleaning member for cleaning said second rotational member, and wherein, when a next image forming operation is performed after a continuous image forming operation for continuously forming images on a pluraity of recording materials is completed, a time period required for supplying power to said heating member and driving said first rotational member and said second rotational member before the next image forming operation is made longer when the number of recording materials having images continuously formed thereon is greater than a predetermined number of recording materials than when the number of recording materials is lesser.

7. An image forming apparatus according to claim 6, wherein said first rotational member is a fixing roller, and said heating member is provided in the interior of said fixing roller, and said separating member is in contact with said fixing roller, and said second rotational member is a pressure roller, said cleaning member being in contact with said pressure roller.

8. An image forming apparatus comprising:

unfixed image forming means for forming unfixed images; and fixing means for fixing the unfixed images formed by said unfixed image forming means on a recording material, wherein said fixing means includes a first rotational member and a second rotation member for pinching and conveying the recording material bearing the unfixed images thereon, a heating member for generating heat by supplying power and heating said rotational member, a separating member for separating the recording material from said first rotational member, and a cleaning member for cleaning said second rotational member; and wherein, when a next image forming operation is performed after a continuous image forming operation for continuously forming images on a pluraity of recording materials is completed, a time period required for supplying power to said heating member and driving said first rotational member and said second rotational member before the next image forming operation is increased in accordance with an increase in the number of recording materials having images continuously formed thereon.

9. An image forming apparatus according to claim 8, wherein said first rotational member is a fixing roller, and said heating member is provided in the interior of said fixing roller, and said separating member is in contact with said fixing roller, and said second rotational member is a pressure roller, said cleaning being in contact with said pressure roller.

* * * * *

UNITED STATES PATENT AND TRADEMARK OFFICE

CERTIFICATE OF CORRECTION

PATENT NO. : 6,181,890 B1
DATED : January 30, 2001
INVENTOR(S) : Hiroshi Kataoka et al.

It is certified that error appears in the above-identified patent and that said Letters Patent is hereby corrected as shown below:

Title page,
Item [57], line 2, "and that" should read -- and the controller --; and
Line 5, "completed" should read -- is completed --.

Column 5,
Line 29, "will" should read -- will be --.

Column 7,
Line 9, "sheet" should read -- sheets--.

Column 8,
Line 14, "by" should read -- for --; and
Line 15, "is" should be deleted.

Column 10,
Line 19, "sheet" should read -- sheets --;
Line 30, "to" should read -- in --;
Line 38, "second" should read --seconds --; and
Line 40, "second," should read -- seconds, --.

Column 11,
Line 10, "may," should read -- many, --;
Line 33, "craws" should read -- claws--; and
Line 66, "has" should read --have --.

Column 13,
Line 14, "mark α" should read -- mark Δ --; and
Line 19, "pinted" should read -- printed --.

Column 14,
Line 67, "rational diving" should read -- rotational driving--.

UNITED STATES PATENT AND TRADEMARK OFFICE

CERTIFICATE OF CORRECTION

PATENT NO. : 6,181,890 B1
DATED : January 30, 2001
INVENTOR(S) : Hiroshi Kataoka et al.

It is certified that error appears in the above-identified patent and that said Letters Patent is hereby corrected as shown below:

Column 15,
Line 30, "recoding" should read -- recording --.

Column 16,
Line 22, "rotation" should read -- rotational --;
Line 25, "said" should read -- said first --;
Line 32, "pluraity" should read -- plurality --; and
Line 45, "cleaning" should read -- cleaning member --.

Signed and Sealed this

Fifth Day of February, 2002

*Attest:*

*Attesting Officer*

JAMES E. ROGAN
*Director of the United States Patent and Trademark Office*